US011623327B2

(12) United States Patent
Naito

(10) Patent No.: US 11,623,327 B2
(45) Date of Patent: Apr. 11, 2023

(54) RATCHET WRENCH HANDLE

(71) Applicant: KO-KEN TOOL CO., LTD., Shizuoka-Pref. (JP)

(72) Inventor: Takamichi Naito, Shizuoka-Pref. (JP)

(73) Assignee: KO-KEN TOOL CO., LTD., Shizuoka-Pref. (JP)

( * ) Notice: Subject to any disclaimer, the term of this patent is extended or adjusted under 35 U.S.C. 154(b) by 0 days.

(21) Appl. No.: 17/510,792

(22) Filed: Oct. 26, 2021

(65) Prior Publication Data

US 2022/0134516 A1 May 5, 2022

(30) Foreign Application Priority Data

Oct. 30, 2020 (JP) ..... JP2020-182236

(51) Int. Cl.
*B25B 13/46* (2006.01)

(52) U.S. Cl.
CPC ..... *B25B 13/463* (2013.01)

(58) Field of Classification Search
CPC ..... B21B 13/463; B25B 13/46; B25B 13/461; B25B 13/462; B25B 13/463; B25B 13/465; B25B 13/468; B25B 13/00; B25B 13/04; B25B 13/06; B25B 13/36; B25B 13/40; B25B 13/48; B25B 13/56; B25B 23/0007; B25B 23/1427
USPC ..... 81/61, 63, 63.1, 63.2
See application file for complete search history.

(56) References Cited

U.S. PATENT DOCUMENTS 2,978,081 A * 4/1961 Lundin ..... B25B 13/463 81/63

FOREIGN PATENT DOCUMENTS

DE 20110868 U1 * 9/2001 ..... B25B 13/463
JP 5568273 8/2014

* cited by examiner

*Primary Examiner* — Monica S Carter
*Assistant Examiner* — Steven Huang
(74) *Attorney, Agent, or Firm* — Wenderoth, Lind & Ponack, L.L.P.

(57) ABSTRACT

A ratchet wrench handle includes an operation piece which is composed of two partial members including a claw member and a receiving member. The ratchet wrench handle is configured such that, when positive rotation-aimed operation teeth of the claw member are engaged with ratchet teeth of a rotation member, a wedge effect produced by the positive rotation-aimed operation teeth of the claw member and a positive rotation-aimed sloping face of the claw member is configured to make the rotation member stop rotation, which allows an adapter to be rotated in a positive direction.

3 Claims, 10 Drawing Sheets

- THE ARROWED LINE " ⇦ " INDICATES THE DIRECTION IN WHICH THE ROTATION MEMBER 3 ROTATES.
- EACH OF THE ARROWED LINES " ⬅ " INDICATES THE FORCE THAT THE ROTATION MEMBER 3 APPLIES ON THE OPERATION PIECE 9.
- EACH OF THE ARROWED LINES " ← " INDICATES THE DIRECTION IN WHICH THE OPERATION PIECE 9 RECEIVES THE FORCE.

RATCHET WRENCH HANDLE

BACKGROUND OF THE INVENTION

Field of the Invention

The present invention relates to a ratchet wrench handle for fastening and loosening a bolt, with an adapter (a socket) assembled to a rotation member provided at the handle head.

Description of the Related Art

There has been known a ratchet wrench handle for fastening and loosening a bolt, with an adapter assembled to a rotation member provided at the handle head, as shown, for example, by FIG. 10 as a ratchet wrench handle A' (see Prior Art Document 1 as mentioned below).
Prior Art Document 1: Japanese Patent No. 5568273

SUMMARY OF THE INVENTION

Problem to be Solved by the Invention

However, the ratchet wrench handle A' according to the aforesaid Prior Art Document 1 is provided with a fairly small number of ratchet teeth, for example, 36 ratchet teeth. Thus, as shown in FIG. 6 that will be described in detail later, in order for one convex of the ratchet teeth 6' to go over one convex of either a positive rotation-aimed operation teeth or a reverse rotation-aimed operation teeth provided on an operation piece 9', a handle 1' had to be swung wide approximately 10 degrees.

Then, in the ratchet wrench handle A' of the aforesaid Prior Art Document 1, an attempt was made to nearly double the number of convexes of the ratchet teeth 6' of the rotation member 3' and the number of convexes of the positive rotation-aimed operation teeth and the reverse rotation-aimed operation teeth of the operation piece 9'. However, because the ratchet wrench handle A' of the aforesaid Prior Art Document 1 is constructed, as shown in FIG. 10, such that the rotation torque generated by the rotation member 3' is received, via the ratchet teeth 6', by the teeth of the operation piece 9', and then is received by the part of the handle head 1*a*' which is located closer to a switch member 14' than an assembling bolt 10', 36 convexes was the maximum limit; and in order to increase the number of convexes of the ratchet teeth 6' of the rotation member 3' and the number of convexes of the positive rotation-aimed operation teeth and the reverse rotation-aimed operation teeth of the operation piece 9', it was required that each convex be made much smaller, which caused another problem that the ratchet teeth 6' of the rotation member 3' and the positive/reverse rotation-aimed operation teeth of the operation piece 9' slide over each other.

The present invention has been made in view of the above-mentioned problems, and an object of the present invention is to provide a ratchet wrench handle that can be used with a reduced swing width of the handle without reducing the torque at the time of rotating a tool and without increasing the size of the handle head, thereby realizing higher efficiency, quality and workability than the conventional one.

Means to Solve the Problems

In order to solve the above-mentioned problems, a ratchet wrench handle according to one embodiment of the present invention comprises: a rotation member disposed at a handle head located at a distal end of an operation handle and provided with a portion for attaching an adapter, and an operation piece provided with positive rotation-aimed operation teeth and reverse rotation-aimed operation teeth, said rotation member being further provided with ratchet teeth continuously formed on a periphery of the rotation member to engage, through operating a switch member, with either one side chosen between the positive rotation-aimed operation teeth and the reverse rotation-aimed operation teeth provided on the operation piece, thereby to rotate the operation handle in the positive or reverse direction; wherein the operation piece is composed of two partial members, i.e., a claw member provided, on the ratchet teeth side thereof, with the positive rotation-aimed operation teeth and the reverse rotation-aimed operation teeth that face and engage with the ratchet teeth, and a receiving member rotatably mounted on the handle head via an assembling bolt such that the receiving member is provided with a cam edge to engage with the switch member and abuts the switch member side of the claw member by applying the side of the receiving member which is located opposite to the cam edge, with the assembling bolt therebetween; the claw member is provided, on its switch member side which is the side of the claw member opposite the positive rotation-aimed operation teeth and the reverse rotation-aimed operation teeth, with a claw member's positive rotation-aimed sloping face and a claw member's reverse rotation-aimed sloping face that are opposite to the positive rotation-aimed operation teeth and the reverse rotation-aimed operation teeth respectively such that the claw member's positive rotation-aimed sloping face and the claw member's reverse rotation-aimed sloping face are formed to slope down in such a manner that the distance between the range of the claw member's positive rotation-aimed sloping face and the claw member's reverse rotation-aimed sloping face and the range of the positive rotation-aimed operation teeth and the reverse rotation-aimed operation teeth is gradually increased as those sloping faces go away from the center of the claw member respectively; and the receiving member 9*b* is provided, on its claw member side, with a receiving member's positive rotation-aimed sloping face and a receiving member's reverse rotation-aimed sloping face that abut the claw member's positive rotation-aimed sloping face and the claw member's reverse rotation-aimed sloping face respectively when the operation handle is rotated in the positive or reverse direction.

Besides, in the ratchet wrench handle according to the present invention, the claw member is further provided, on its switch member side and at the same time, on its claw member's positive rotation-aimed sloping face side, with a claw member's reverse idling rotation-time pressing face for pressing the receiving member, thereby to idle the claw member and the receiving member as one body when the operation handle idles in the reverse direction. On the other hand, the claw member is further provided, on its switch member side and at the same time, on its claw member's reverse rotation-aimed sloping face side, with a claw member's positive idling rotation-time pressing face for pressing a receiving member, thereby to idle the claw member and the receiving member as one body when the operation handle idles in the positive direction. The receiving member is further provided, on its claw member side and at the same time, on its receiving member's positive rotation-aimed sloping face side, with a receiving member's reverse idling rotation-time pressing face to be pressed by the claw member's reverse idling rotation-time pressing face, thereby to idle the claw member and the receiving member as one body when the operation handle idles in the reverse direction. On the other hand, the receiving member is further provided, on its claw member side and at the same time, on its receiving member's reverse rotation-aimed sloping face side, with a receiving member's positive idling rotation-time pressing face to be pressed by the claw member's positive idling rotation-time pressing face thereby to idle the claw member and the receiving member as one body when the operation handle idles in the positive direction.

Furthermore, an angle formed between the claw member's positive rotation-aimed sloping face and the claw member's reverse idling rotation-time pressing face, an angle formed between the claw member's reverse rotation-aimed sloping face and the claw member's positive idling rotation-time pressing face, an angle formed between the receiving member's positive rotation-aimed sloping face and the receiving member's reverse idling-time pressing face, and an angle formed between the receiving member's reverse rotation-aimed sloping face and the receiving member's positive rotation-time pressing face are each an obtuse angle larger than 90 degrees and smaller than 180 degrees.

Moreover, the claw member's positive rotation-aimed sloping face is divided by the claw member's reverse idling rotation-time pressing face into two parts; the claw member's reverse rotation-aimed sloping face is divided by the claw member's positive idling rotation-time pressing face into two parts; the receiving member's positive rotation-aimed sloping face is divided by the receiving member's reverse idling rotation-time pressing face into two parts; and the receiving member's reverse rotation-aimed sloping face is divided by the receiving member's positive idling rotation-time pressing face into two parts. The divided claw member's positive rotation-aimed sloping face, claw member's reverse rotation-aimed sloping face, receiving member's positive rotation-aimed sloping face and receiving member's reverse rotation-aimed sloping face are formed such that the sloping face located at an outer position than each of the claw member's reverse idling rotation-time pressing face, the claw member's positive idling rotation-time pressing face, the receiving member's reverse idling rotation-time pressing face and the receiving member's positive idling rotation-time pressing face has an inclination angle closer to the horizontal than the sloping face located at an inner position than each of the aforesaid pressing faces.

Advantageous Effects of the Invention

In a ratchet wrench handle according to the present invention, the operation piece is composed of two partial members, i.e., a claw member provided, on the ratchet teeth side thereof, with the positive rotation-aimed operation teeth and the reverse rotation-aimed operation teeth that face and engage with the ratchet teeth, and a receiving member rotatably mounted on the handle head via an assembling bolt such that the receiving member is provided with a cam edge to engage with the switch member and abuts the switch member side of the claw member by applying the side of the receiving member which is located opposite to the cam edge, over the assembling bolt located therebetween; and the claw member is provided, on its switch member side which is the side of the claw member opposite the positive rotation-aimed operation teeth and the reverse rotation-aimed operation teeth, with a claw member's positive rotation-aimed sloping face and a claw member's reverse rotation-aimed sloping face that are opposite to the positive rotation-aimed operation teeth and the reverse rotation-aimed operation teeth respectively such that the claw member's positive rotation-aimed sloping face and the claw member's reverse rotation-aimed sloping face are formed to slope down in such a manner that the distance between the range of the claw member's positive rotation-aimed sloping face and the claw member's reverse rotation-aimed sloping face and the range of the positive rotation-aimed operation teeth and the reverse rotation-aimed operation teeth is gradually widened as those sloping faces go away from the center of the claw member respectively; and the receiving member is provided, on its claw member side, with a receiving member's positive rotation-aimed sloping face and a receiving member's reverse rotation-aimed sloping face that abut the claw member's positive rotation-aimed sloping face and the claw member's reverse rotation-aimed sloping face respectively when the operation handle is rotated in the positive and reverse directions.

Therefore, when an adapter is to be rotated in the positive direction, with the positive rotation-aimed operation teeth of the claw member engaged with the ratchet teeth of the rotation member, a wedge effect generated by the positive rotation-aimed operation teeth of the claw member and the claw member's positive rotation-aimed sloping face of the claw member makes the rotation member stop its rotation, which allows the adapter t to be rotated in the positive direction. On the other hand, when an adapter is to be rotated in the reverse direction, with the reverse rotation-aimed operation teeth of the claw member engaged with the ratchet teeth of the rotation member, a wedge effect generated by the reverse rotation-aimed operation teeth of the claw member and the claw member's reverse rotation-aimed sloping face of the claw member makes the rotation member stop its rotation, which allows the adapter to be rotated in the reverse direction.

Thus, in the present invention, because the torque at the time of rotating the tool is received, via the ratchet teeth of the rotation member, by the operation piece composed of two partial members, i.e., the claw member and the receiving member, thereby transmitting the rotation torque to the part of the handle head closer to the switch member than the assembling bolt, the adapter can be rotated without reducing the torque at the time of rotating the tool and without increasing the size of the handle head.

Furthermore, because the operation piece is composed of the two partial members, i.e., the claw member and the receiving member, a wedge effect generated by a pair of the positive rotation-aimed operation teeth of the claw member and the claw member's positive rotation-aimed sloping face or by a pair of the reverse rotation-aimed operation teeth of the claw member and claw member's reverse rotation-aimed sloping face makes the rotation member stop its rotation, thereby rotating the adapter in the positive and reverse directions. Thus, increase of the number of convexes of the ratchet teeth, the positive rotation-aimed operation teeth and the reverse rotation-aimed operation teeth does not cause slippage, and besides, the reduced swing width of the handle provides a high efficiency and high quality ratchet wrench handle, improving workability.

DETAILED DESCRIPTION OF THE PREFERRED EMBODIMENTS

Next, one preferred embodiment of a ratchet wrench handle A according to the present invention will be described with reference to the accompanying drawings. The under-described embodiment is only one example of the present invention, and the present invention is not limited thereto, and can be altered appropriately within the range of the technical idea of the present invention. Particularly, the following description refers to the number of convexes of ratchet teeth 6 of a rotation member 3 as 72 which is twice as many as that of the conventional one. However, this is just an example, and the number of convexes of the ratchet teeth 6 can also be, for example, 60 which is a smaller number than 72; 90 or 108 which is a larger number than 72; or other appropriate numbers. These numbers are, of course, included in the range of the present invention.

The fundamental construction of a ratchet wrench handle A according to one embodiment of the present invention is the same as that of the ratchet wrench handle disclosed by the aforesaid Prior Art Document 1, Japanese Patent No. 5568273 that the present applicant previously obtained, except for the number of convexes of the ratchet teeth of the rotation member 3 and the construction of an operation piece 9. Thus, the construction and operation of each of the rotation member 3 and the operation piece 9, which are different from those of the ratchet wrench handle disclosed by the Japanese Patent No. 5568273, will mainly be described hereafter.

Figure 1:
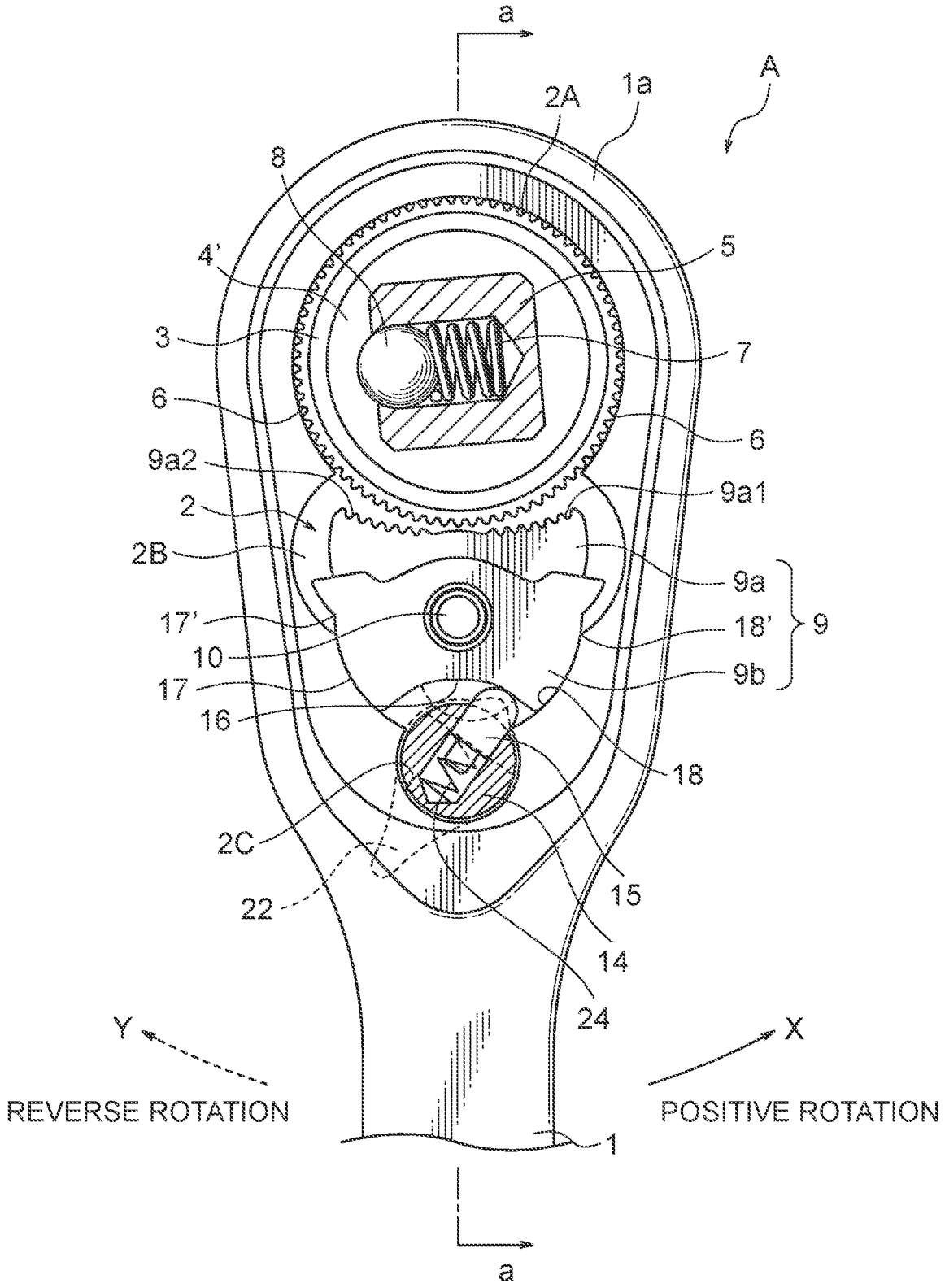
FIG. 1 is a front view of an unveiled main section of a ratchet wrench handle according to one embodiment of the present invention.
Figure 2:
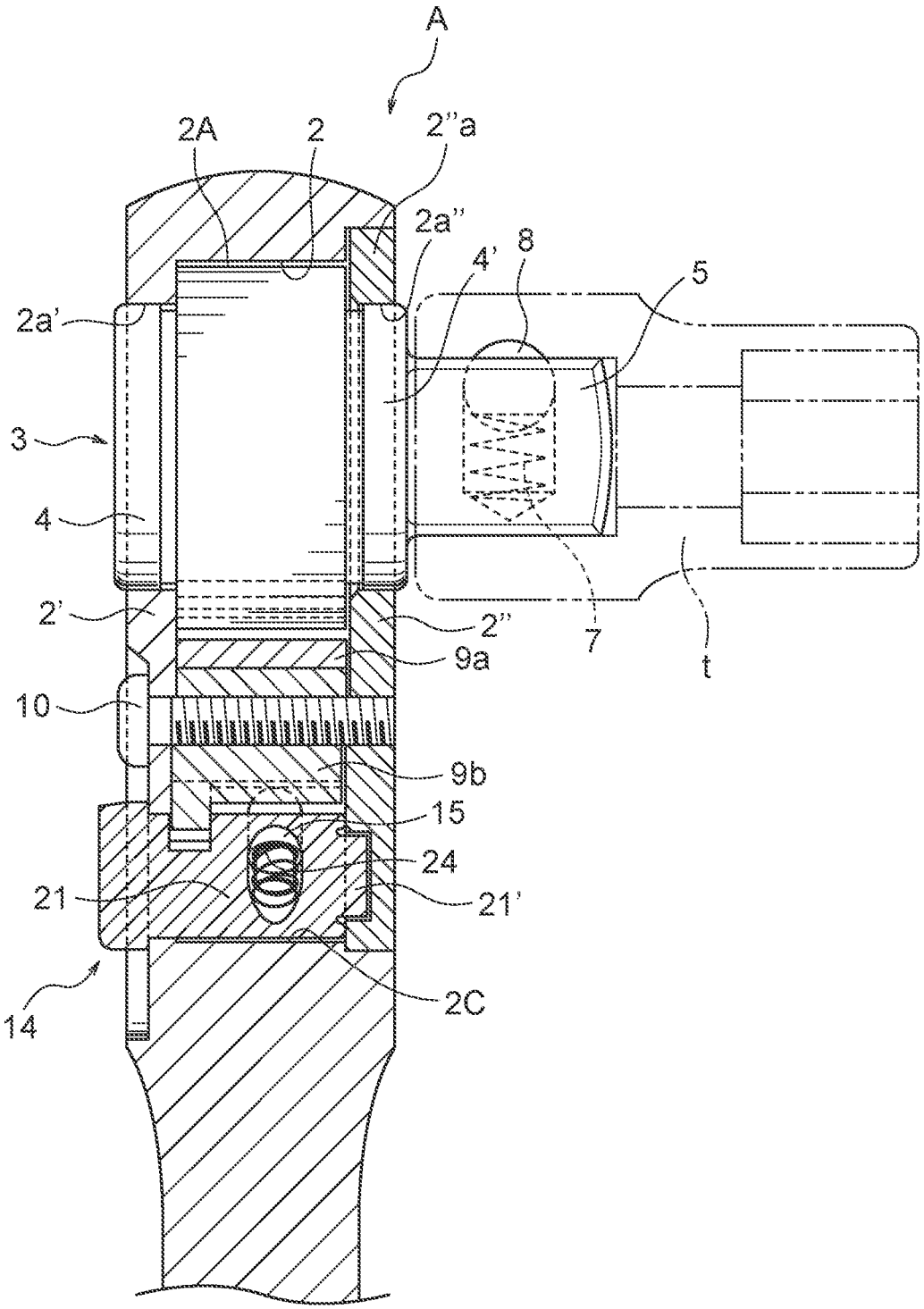
FIG. 2 is a cross-sectional view taken along line a-a indicated in FIG. 1.
Figure 3:
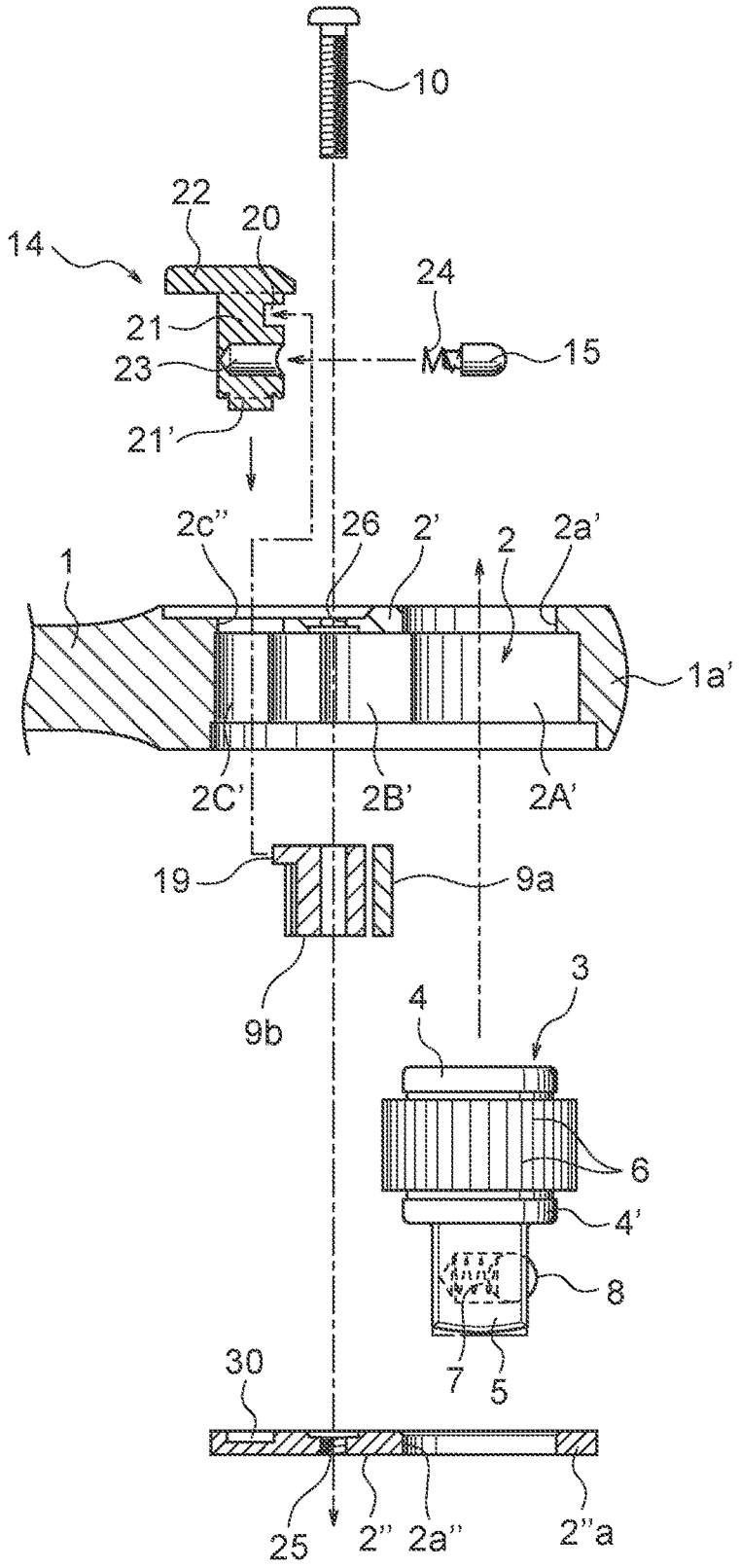
FIG. 3 is a cross-sectional view of the ratchet wrench handle in the state of being disassembled according to one embodiment of the present invention.

As shown by FIGS. 1 to 3, a ratchet wrench handle A according to one embodiment of the present invention comprises: a rotation member 3 disposed at a handle head 1*a* located at a distal end of an operation handle 1 and provided with a portion for attaching an adapter t, and an operation piece 9 provided with positive rotation-aimed operation teeth 9*a*1 and reverse rotation-aimed operation teeth 9*a*2, said rotation member 3 being further provided with ratchet teeth 6 continuously formed on a periphery of the rotation member 3 to engage, through operating a switch member 14, with either one side chosen between the positive rotation-aimed operation teeth 9*a*1 and the reverse rotation-aimed operation teeth 9*a*2 provided on the operation piece 9, thereby to rotate the adapter t in a positive or reverse direction. However, unlike the ratchet wrench handle disclosed by the aforesaid Prior Art Document 1, Japanese Patent No. 5568273, in the present invention, the number of convexes of the ratchet teeth 6 continuously formed on the periphery of said rotation member 3 is doubled from 36 to 72, and accordingly, the number of convexes of the positive rotation-aimed operation teeth 9*a*1 and the reverse rotation-aimed operation teeth 9*a*2 is also doubled; and the operation piece 9 is not constructed as one single member, but is composed of two partial members, i.e., a claw member 9*a* and a receiving member 9*b*. A collar 11, which was provided on the periphery of an assembling bolt 10 in the aforesaid Prior Art Document 1, Japanese Patent No. 5568273, is omitted.

(An Operation Piece 9)

As shown by FIGS. 1 to 3, the operation piece 9 is composed of two partial members, i.e., a claw member 9*a* forming the upper part (i.e., the ratchet teeth 6 side) of the operation piece 9 and provided, on the ratchet teeth 6 side thereof, with positive rotation-aimed operation teeth 9*a*1 and reverse rotation-aimed operation teeth 9*a*2 that face and engage with the ratchet teeth 6; and a receiving member 9*b* that is provided with a cam edge 16 to engage with a switch member 14 and abuts the switch member 14 side of the claw member 9*a* by applying the side of the receiving member 9*b* which is located opposite to the cam edge, over the assembling bolt located therebetween.

(A Claw Member 9*a*)

Figure 4A:
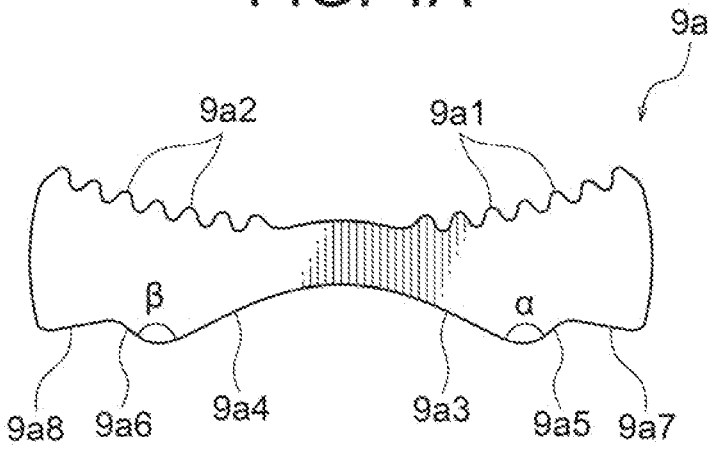
FIG. 4A and FIG. 4B respectively show plan views of a claw member and a receiving member that collaboratively form an operation piece of the ratchet wrench handle according to one embodiment of the present invention.

As shown by FIG. 4A, a claw member 9*a* is provided, on its upper side as seen in the Figure, with positive rotation-aimed operation teeth 9*a*1 and reverse rotation-aimed operation teeth 9*a*2 to engage with the ratchet teeth 6 continuously formed on a periphery of said rotation member 3, and on its lower side as seen in the Figure (i.e., on its switch member 14 side which is the side of the claw member 9*a* opposite the positive rotation-aimed operation teeth 9*a*1 and the reverse rotation-aimed operation teeth 9*a*2), with a claw member's first positive rotation-aimed sloping face 9*a*3 and a claw member's first reverse rotation-aimed sloping face 9*a*4 that are opposite to the positive rotation-aimed operation teeth 9*a*1 and the reverse rotation-aimed operation teeth 9*a*2 respectively such that the claw member's first positive rotation-aimed sloping face 9*a*3 and the claw member's first reverse rotation-aimed sloping face 9*a*4 are located on the right and left sides of the lower side of the claw member 9*a*. The claw member's first positive rotation-aimed sloping face 9*a*3 and the claw member's first reverse rotation-aimed sloping face 9*a*4 are formed to slope down in such a manner that the distance between the range of the claw member's first positive rotation-aimed sloping face 9*a*3 and the claw member's first reverse rotation-aimed sloping face 9*a*4 and the range of the positive rotation-aimed operation teeth 9*a*1 and the reverse rotation-aimed operation teeth 9*a*2 is gradually increased as the sloping faces 9*a*3 and 9*a*4 go away from the center of the claw member 9*a* respectively.

The claw member 9*a* is further provided, on its switch member 14 side and at the same time, on its claw member's first positive rotation-aimed sloping face 9*a*3 side, with a claw member's reverse idling rotation-time pressing face 9*a*5 for pressing the receiving member 9*b* thereby idling the claw member 9*a* and the receiving member 9*b* as one body, when the ratchet wrench handle A idles in the reverse direction. On the other hand, the claw member 9*a* is further provided, on its switch member 14 side and at the same time, on its claw member's first reverse rotation-aimed sloping face 9*a*4 side, with a claw member's positive idling rotation-time pressing face 9*a*6 for pressing the receiving member 9*b* thereby idling the claw member 9*a* and the receiving member 9*b* as one body, when the ratchet wrench handle A idles in the positive direction.

In this respect, an angle α formed between the claw member's first positive rotation-aimed sloping face 9*a*3 and the claw member's reverse idling rotation-time pressing face 9*a*5 is an obtuse angle larger than 90 degrees and smaller than 180 degrees. Similarly, an angle β formed between the claw member's first reverse rotation-aimed sloping face 9*a*4 and the claw member's positive idling rotation-time pressing face 9*a*6 is an obtuse angle larger than 90 degrees and smaller than 180 degrees.

Furthermore, at an outer side of the claw member's reverse idling rotation-time pressing face 9*a*5, in other words, on the opposite side from the claw member's first positive rotation-aimed sloping face 9*a*3 via the claw member's reverse idling rotation-time pressing face 9*a*5 is provided a claw member's second positive rotation-aimed sloping face 9*a*7. Similarly, at an outer side of the claw member's positive idling rotation-time pressing face 9*a*6, in other words, on the opposite side from the claw member's first reverse rotation-aimed sloping face 9*a*4 via the claw member's positive idling rotation-time pressing face 9*a*6 is provided a claw member's second reverse rotation-aimed sloping face 9*a*8.

This means that the claw member's first positive rotation-aimed sloping face 9*a*3 and the claw member's second positive rotation-aimed sloping face 9*a*7 are located across from each other, with the claw member's reverse idling rotation-time pressing face 9*a*5 disposed between them; and on the other hand, the claw member's first reverse rotation-aimed sloping face 9*a*4 and the claw member's second reverse rotation-aimed sloping face 9*a*8 are located across from each other, with the claw member's positive idling rotation-time pressing face 9*a*6 disposed between them.

Even when the angle of the claw member 9*a* engaged with the ratchet teeth 6 of the rotation member 3 changes at the positive rotation time such as to change the angle of the claw member 9*a* to the receiving member 9*b*, in order to transmit the rotation torque, stress, etc. generated by the rotation member 3 from the claw member 9*a* to the receiving member 9*b* without fail, with the ratchet teeth 6 and the positive rotation-aimed operation teeth 9*a*1 surely engaged with each other without slippage, the claw member's first positive rotation-aimed sloping face 9*a*3 and the claw member's second positive rotation-aimed sloping face 9*a*7 are formed to have different inclination angles such that the inclination angle of the claw member's second positive rotation-aimed sloping face 9*a*7 located at the outer side is closer to the horizontal than that of the claw member's first positive rotation-aimed sloping face 9*a*3 located at the inner side. Similarly, in order to transmit, at the reverse rotation time, the rotation torque, stress, etc. generated by the rotation member 3 from the claw member 9*a* to the receiving member 9*b* without fail, with the ratchet teeth 6 and the positive rotation-aimed operation teeth 9*a*1 surely engaged with each other without slippage, the inclination angle of the claw member's second reverse rotation-aimed sloping face 9*a*8 located at the outer side is closer to the horizontal than that of the claw member's first reverse rotation-aimed sloping face 9*a*4 located at the inner side.

Figure 4B:
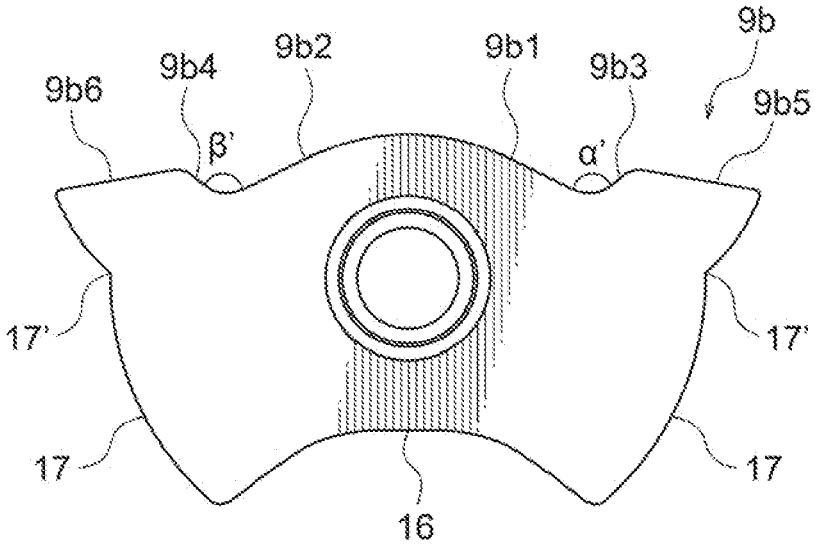

As shown by FIGS. 1 to 3, etc., the receiving member 9*b* forms a lower part of the operation piece 9, i.e., the switch member 14 side of the operation piece 9. As shown by FIGS. 4A and 4B, the receiving member 9*b* is provided, on its claw member 9*a* side, with a receiving member's first positive rotation-aimed sloping face 9*b*1 and a receiving member's first reverse rotation-aimed sloping face 9*b*2 that abut the claw member's first positive rotation-aimed sloping face 9*a*3 and the claw member's first reverse rotation-aimed sloping face 9*a*4 respectively when an adapter t is rotated in the positive or reverse direction. When an adapter t is rotated in the positive direction in such a manner that the positive rotation-aimed operation teeth 9*a*1 of the claw member 9*a* is engaged with the ratchet teeth 6 of the rotation member 3, a wedge effect generated by the positive rotation-aimed operation teeth 9*a*1 of the claw member 9*a* and the claw member's first positive rotation-aimed sloping face 9*a*3 of the claw member 9*a* makes the rotation member 3 stop its rotation, which allows the adapter t to be rotated in the positive direction. On the other hand, when the adapter t is rotated in the reverse direction in such a manner that the reverse rotation-aimed operation teeth 9*a*2 of the claw member 9*a* is engaged with the ratchet teeth 6 of the rotation member 3, a wedge effect generated by the reverse rotation-aimed operation teeth 9*a*2 of the claw member 9*a* and the claw member's first reverse rotation-aimed sloping face 9*a*4 of the claw member 9*a* makes the rotation member 3 stop its rotation, which allows the adapter t to be rotated in the positive direction.

The receiving member 9*b* is further provided, on its claw member 9*a* side and at the same time, on its receiving member's first positive rotation-aimed sloping face 9*b*1 side, with a receiving member's reverse idling rotation-time pressing face 9*b*3 to be pressed by the claw member's reverse idling rotation-time pressing face 9*a*5 thereby idling the claw member 9*a* and the receiving member 9*b* as one body, when the ratchet wrench handle A idles in the reverse direction. On the other hand, the receiving member 9*b* is further provided, on its claw member 9*a* side and at the same time, on its receiving member's first reverse rotation-aimed sloping face 9*b*2 side, with a receiving member's positive idling rotation-time pressing face 9*b*4 to be pressed by the claw member's positive idling rotation-time pressing face 9*a*6 thereby idling the claw member 9*a* and the receiving member 9*b* as one body, when the ratchet wrench handle A idles in the positive direction.

In this respect, an angle α' formed between the receiving member's first positive rotation-aimed sloping face 9*b*1 and the receiving member's reverse idling rotation-time pressing face 9*b*3 is identical with an angle α formed between the claw member's first positive rotation-aimed sloping face 9*a*3 and the claw member's reverse idling rotation-time pressing face 9*a*5, and an angle β' formed by the receiving member's first reverse rotation-aimed sloping face 9*b*2 and the receiving member's positive idling rotation-time pressing face 9*b*4 is identical with an angle formed between the claw member's first reverse rotation-aimed sloping face 9*a*4 and the claw member's positive idling rotation-time pressing face 9*a*6. Each of the angles α, α', β and β' is an obtuse angle larger than 90 degrees and smaller than 180 degrees.

Furthermore, at an outer side of the receiving member's reverse idling rotation-time pressing face 9b3, in other words, on the opposite side from the receiving member's first positive rotation-aimed sloping face 9b1 via the receiving member's reverse idling rotation-time pressing face 9b3 is provided a receiving member's second positive rotation-aimed sloping face 9b5. Similarly, at an outer side of the receiving member's positive idling rotation-time pressing face 9b4, in other words, on the opposite side from the receiving member's first reverse rotation-aimed sloping face 9b2 via the receiving member's positive idling rotation-time pressing face 9b4 is provided a receiving member's second reverse rotation-aimed sloping face 9b6.

Even when the angle of the claw member 9a engaged with the ratchet teeth 6 of the rotation member 3 changes at the positive rotation time such as to change the angle of the claw member 9a to the receiving member 9b, in order to transmit the rotation torque, stress, etc. generated by the rotation member 3 from the claw member 9a to the receiving member 9b without fail, with the ratchet teeth 6 and the positive rotation-aimed operation teeth 9a1 surely engaged with each other without slippage, the inclination angle of the receiving member's second positive rotation-aimed sloping face 9b5 located at the outer side is formed to be closer to the horizontal than that of the receiving member's first positive rotation-aimed sloping face 9b1 located at the inner side, just like the relationship between the inclination angle of the claw member's first positive rotation-aimed sloping face 9a3 and that of the claw member's second positive rotation-aimed sloping face 9a7. Similarly, in order to transmit, at the reverse rotation time, the rotation torque, stress, etc. generated by the rotation member 3 from the claw member 9a to the receiving member 9b without fail, with the ratchet teeth 6 and the positive rotation-aimed operation teeth 9a1 surely engaged with each other without slippage, the inclination angle of the receiving member's second reverse rotation-aimed sloping face 9b6 located at the outer side is closer to the horizontal than that of the receiving member's first reverse rotation-aimed sloping face 9b2 located at the inner side, just like the relationship between the inclination angle of the claw member's first reverse rotation-aimed sloping face 9a4 and that of the claw member's second reverse rotation-aimed sloping face 9a8.

The receiving member 9b is provided, on its lower side, i.e., on its switch member 14 side, with a cam edge 16 with which the distal end of a pressing pin 15 of the switch member 14 engages, in the same way as the Prior Art Document 1.

⟨Operation of the Ratchet Wrench Handle A in a Preferred Embodiment⟩

Next, the operation of a ratchet wrench handle A as formed above in a preferred embodiment will be described as follows.

(A Locked State at the Time of Positive Rotation)

Figure 5:
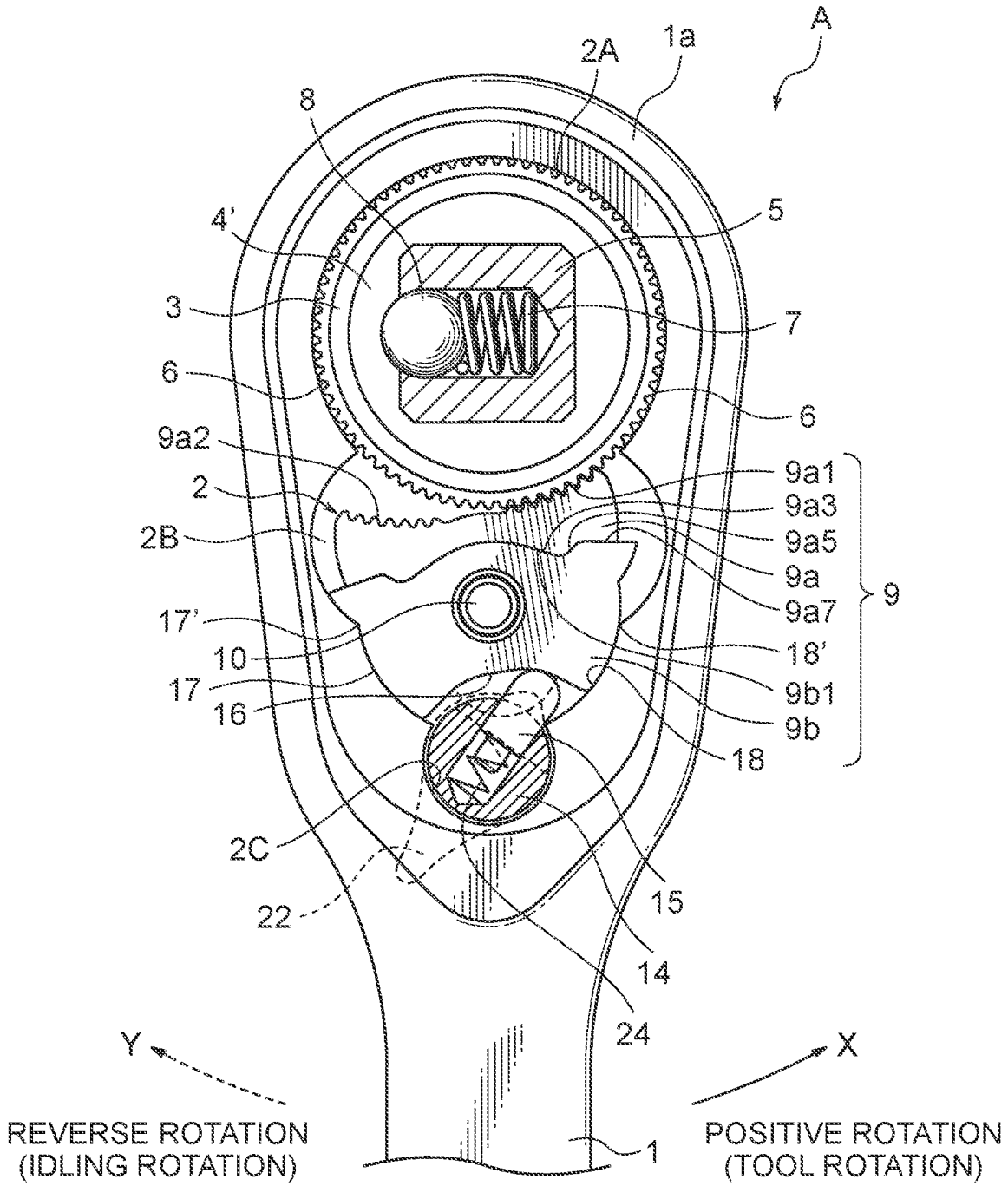
FIG. 5 is a front view of an unveiled main section of the ratchet wrench handle in the locked state at the time of positive rotation according to one embodiment of the present invention.

FIG. 5 shows a locked state of the ratchet wrench handle A at the time of positive rotation according to a preferred embodiment.

As shown by FIG. 5, when the pressing pin 15 of the switch member 14 is inclined to the right side in FIG. 5, the claw member 9a and the receiving member 9b that form the operation piece 9 rotate anti-clockwise about the assembling bolt 10 from the neutral state as shown in FIG. 1 until the positive rotation-aimed operation teeth 9a1 engage with the ratchet teeth 6 of the rotation member 3.

Here, unlike the ratchet wrench handle A' disclosed by the aforesaid Prior Art Document 1, Japanese Patent No. 5568273 wherein the number of convexes of the ratchet teeth 6 is 36, a ratchet wrench handle A according to one embodiment of the present invention has increased the number of convexes of ratchet teeth 6 of the rotation member 3, for example, to the doubled number of 72, and accordingly, has also doubled the number of convexes of each of the positive rotation-aimed operation teeth 9a1 and the reverse rotation-aimed operation teeth 9a2.

Figure 10:
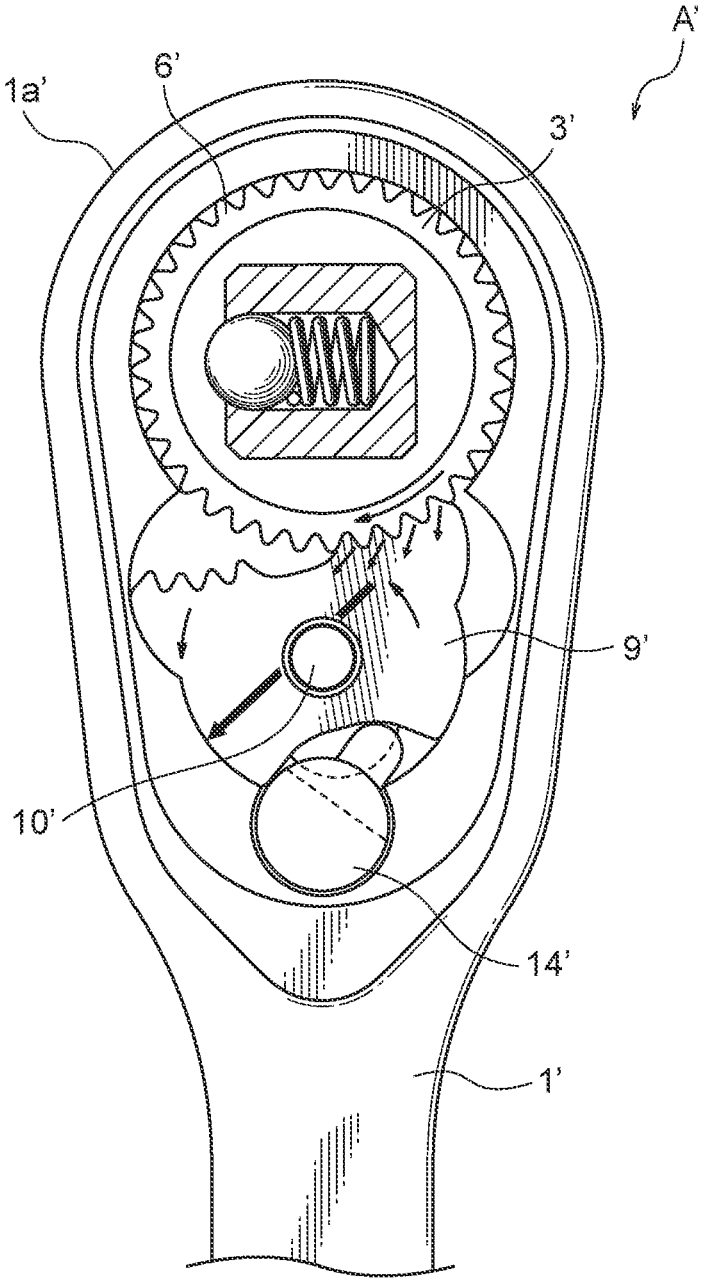
FIG. 10 PRIOR ART
FIG. 10 shows the construction of the conventional ratchet wrench handle recited in the Prior Art Document 1.

In the ratchet wrench handle A' disclosed in the aforesaid Prior Art Document 1, wherein the operation piece 9' is constructed as one single member, and the number of convexes of the ratchet teeth 6' of the rotation member 3' is 36, when the ratchet wrench handle A' is rotated, for example 10 degrees, as shown in FIG. 10, the positive rotation-aimed operation teeth can go over one convex of the ratchet teeth 6'.

Figure 7:
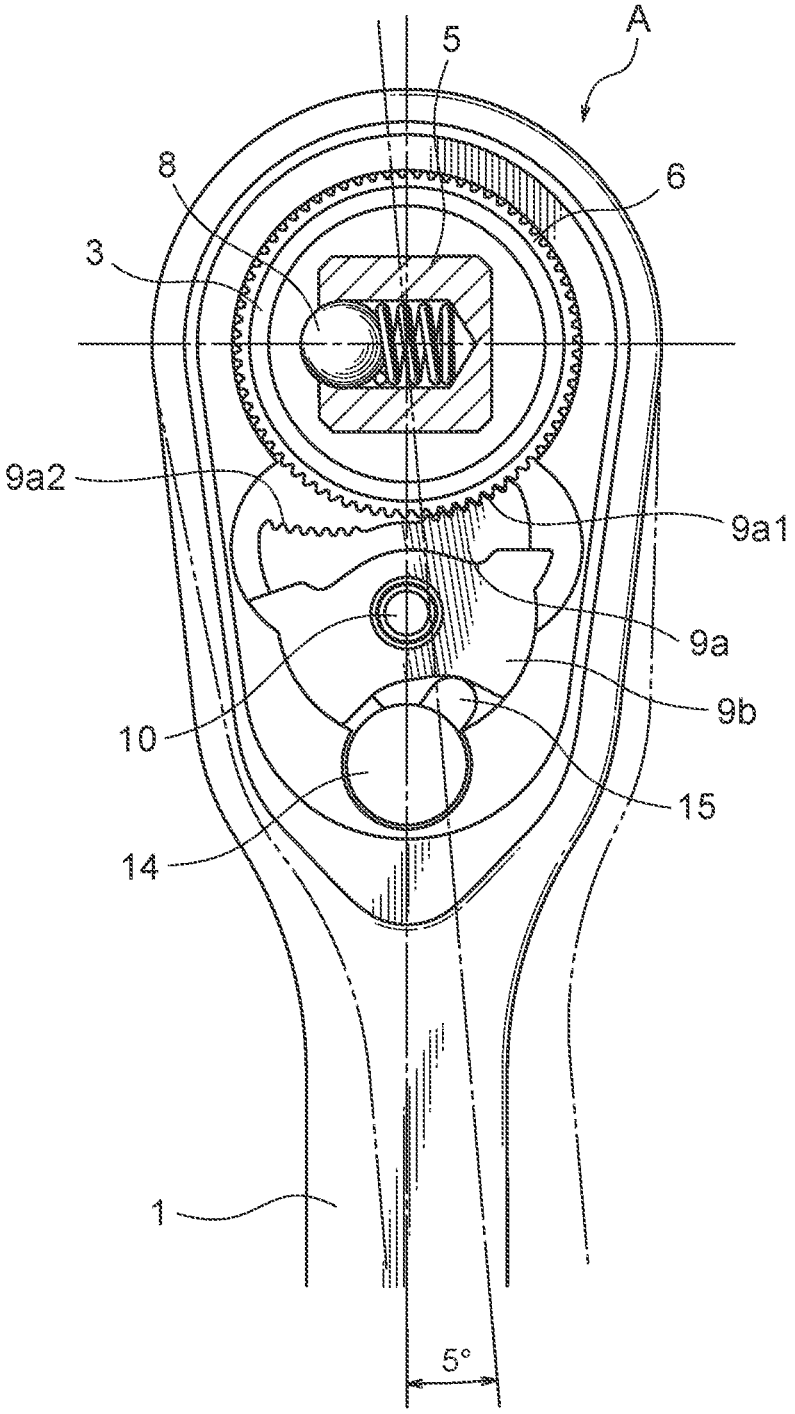
FIG. 7 is an explanatory view showing a rotation angle of an operation handle required to go over one convex of ratchet teeth of a rotation member in the ratchet wrench handle according to one embodiment of the present invention.

In contrast, in a ratchet wrench handle A according to one embodiment of the present invention, wherein the number of convexes of the ratchet teeth 6 of the rotation member 3 has been increased to the doubled number of 72, compared to conventional number of 36, when the ratchet wrench handle A is, as shown in FIG. 7, rotated 5 degrees, which is half of the conventional angle, the positive rotation-aimed operation teeth 9a1 can go over one convex of the ratchet teeth G. In this way, the swing width of the ratchet wrench handle A can be reduced.

Thus, the ratchet wrench handle A according to one embodiment of the present invention allows an operator, if it is as long as the ratchet wrench handle A' disclosed in the aforesaid Prior Art Document 1, to work with only about half of the space that was required in order to go over one convex of the ratchet teeth 6' in the conventional ratchet wrench handle.

Figure 6:
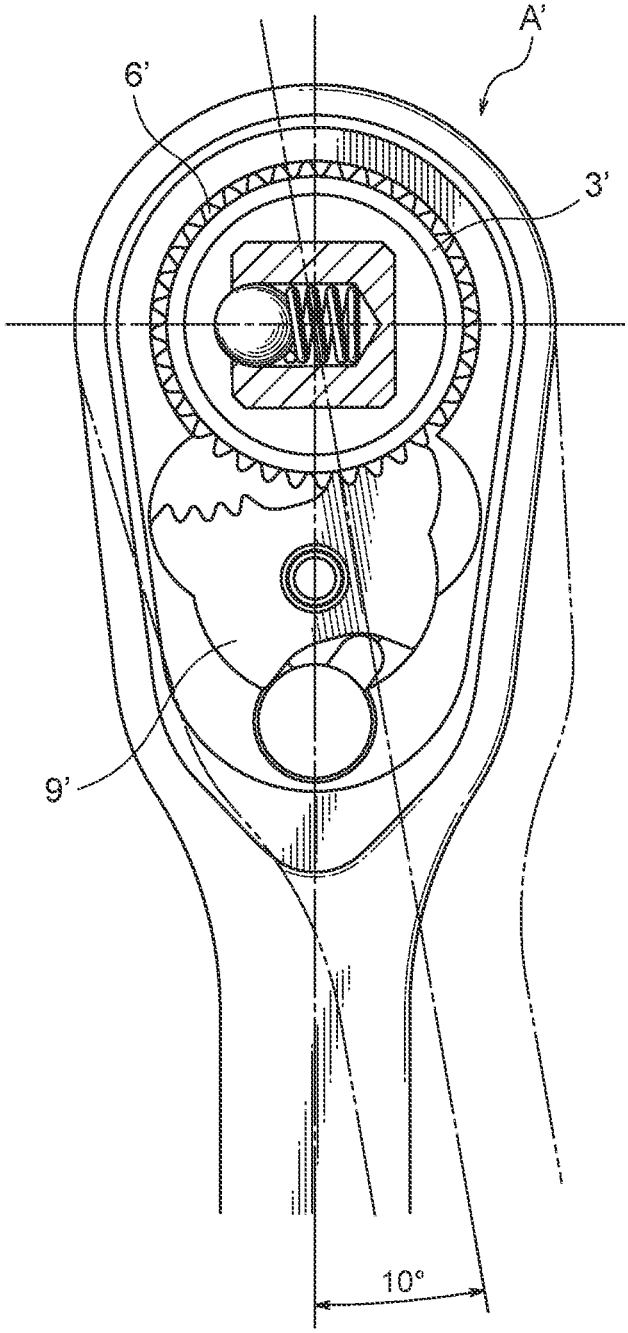
FIG. 6 PRIOR ART
FIG. 6 is an explanatory view showing a rotation angle of an operation handle required to go over one convex of a ratchet teeth of a rotation member in the conventional ratchet wrench handle disclosed by the Prior Art Document 1.

Therefore, compared with the ratchet wrench handle A' disclosed by the aforesaid Prior Art Document 1, Japanese patent No. 5568273 shown in FIG. 6, the ratchet wrench handle A according to one embodiment of the present invention reduces the swing angle of the ratchet wrench handle A to half of the conventional swing angle, as shown in FIG. 7, thereby allowing the ratchet wrench handle to fulfill its function with a swing angle much smaller than that of the conventional one, and improving workability in a narrow space greatly.

When the operation handle 1 is rotated anti-clockwise, the claw member 9a forming a part of the operation piece 9 engages with the ratchet teeth 6 of the rotation member 3, and the claw member 9a and the receiving member 9b that form the operation piece 9 become integral as one body; thereby transmitting the rotation torque of the operation handle 1 to the rotation member 3. In this way, a tool can be rotated anti-clockwise according to the rotation of the operation handle 1.

(When a Tool is Rotated in the Locked State at the Time of Positive Rotation)

When a tool is rotated by using the ratchet wrench handle A according to one embodiment of the present invention, the tool is mounted on the adapter t, and the operation handle 1 is rotated, in a locked state at the time of positive rotation as shown in FIG. 5, in the anti-clockwise direction of X. In this way, the rotation member 3 is rotated, thereby rotating the tool.

More particularly, because the operation piece 9 is composed of the two partial members, i.e., the claw member 9a and the receiving member 9b, when the operation handle 1 is rotated, in a locked state as shown in FIG. 5, in the anti-clockwise direction of X, the claw member's first positive rotation-aimed sloping face 9a3 (see FIG. 4A) and the receiving member's first positive rotation-aimed sloping face 9b1 (see FIG. 4B) are contacted under pressure with each other, and at the same time, the claw member's second positive rotation-aimed sloping face 9a7 (see FIG. 4A) and the receiving member's second positive rotation-aimed sloping face 9b5 (see FIG. 4B) are contacted under pressure with each other. At this time, because of the wedge effect of the claw member 9a, the claw member 9a and the receiving member 9b that form the operation piece 9 become integral as one body.

As mentioned above, the wedge effect of the claw member 9a makes the claw member 9a and the receiving member 9b that form the operation piece 9, become integral as one body, and thus, the rotation torque of the operation handle 1 is transmitted to the rotation member 3. In this way, the rotation member 3 can be rotated in the positive direction, thereby rotating the tool in the positive direction.

Figure 8:
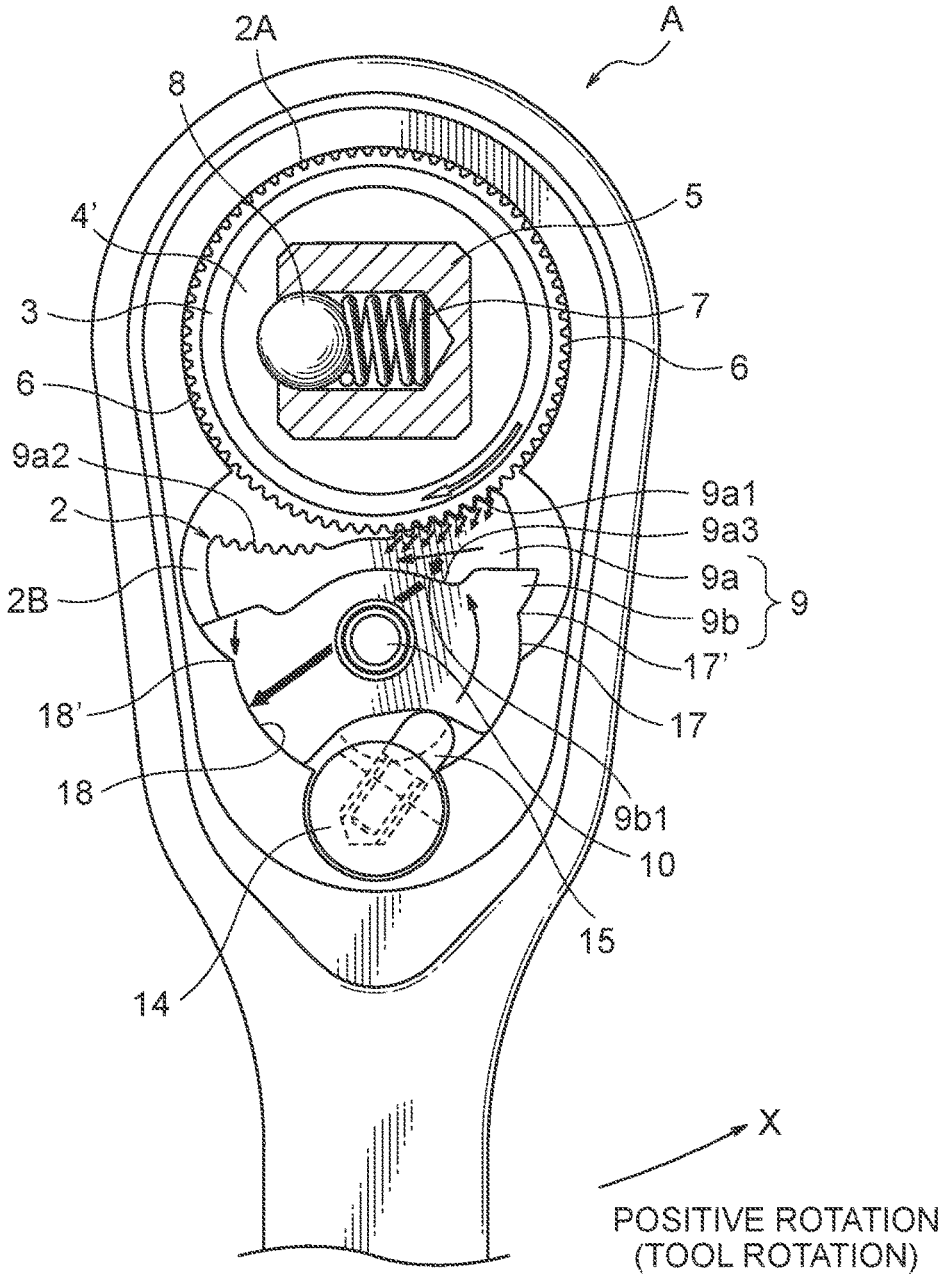
FIG. 8 shows directions of the rotation torque transmitted from the rotation member to a handle head by way of the claw member and the receiving member at the time of positive rotation of the ratchet wrench handle according to one embodiment of the present invention.

Moreover, because the operation piece 9 is composed of the two partial members, i.e., the claw member 9a and the receiving member 9b, when the operation handle 1 is rotated in the anti-clockwise direction of X in order to rotate the adapter t in the positive direction, the ratchet teeth 6 of the rotation member 3 and the positive rotation-aimed operation teeth 9a1 of the claw member 9a are engaged with each other as shown in FIG. 8, at which time the rotation torque is applied on the claw member 9a and the receiving member 9b in the clockwise direction, with the assembling bolt 10 as the center.

In this condition, the claw member's first positive rotation-aimed sloping face 9a3 and the receiving member's first positive rotation-aimed sloping face 9b1 are contacted with each other under pressure strongly, and at the same time, the claw member's second positive rotation-aimed sloping face 9a7 (see FIG. 4A) and the receiving member's second positive rotation-aimed sloping face 9b5 (see FIG. 4B) are contacted with each other under pressure strongly; thereby transmitting the rotation torque of the rotation member 3, by way of the claw member 9a and the receiving member 9b, to a pressure receiving edge 18 positioned lower than the assembling bolt 10, i.e., to a place close to the switch member 14 disposed on the opposite side of the ratchet wrench handle A from the operation handle 1, in the same way as the ratchet wrench handle A' disclosed by the Prior Art Document 1, Japanese Patent No. 5568273.

(Idling in the Reverse Direction in the Locked State at the Time of Positive Rotation)

As mentioned above, in the ratchet wrench handle A according to one embodiment of the present invention, the operation piece 9 is composed of the two partial members, i.e., the claw member 9a and the receiving member 9b. However, when the operation handle 1 is rotated in the reverse clockwise direction of Y, the claw member's reverse idling rotation-time pressing face 9a5 (see FIG. 4A) presses the receiving member's reverse idling rotation-time pressing face 9b3 (see FIG. 4B), thereby enabling the claw member 9a and the receiving member 9b to rotate as one body in the reverse direction of Y, whereby the claw member 9a and the receiving member 9b forming the operation piece 9 swing about the assembling bolt 10, and the ratchet teeth 6 of the rotation member 3 and the positive rotation-aimed operation teeth 9a1 of the claw member 9a slide over each other, which enables idling.

(When a Tool is Rotated in the Locked State at the Time of Reverse Rotation, how is an Idling State Produced?)

Figure 9:
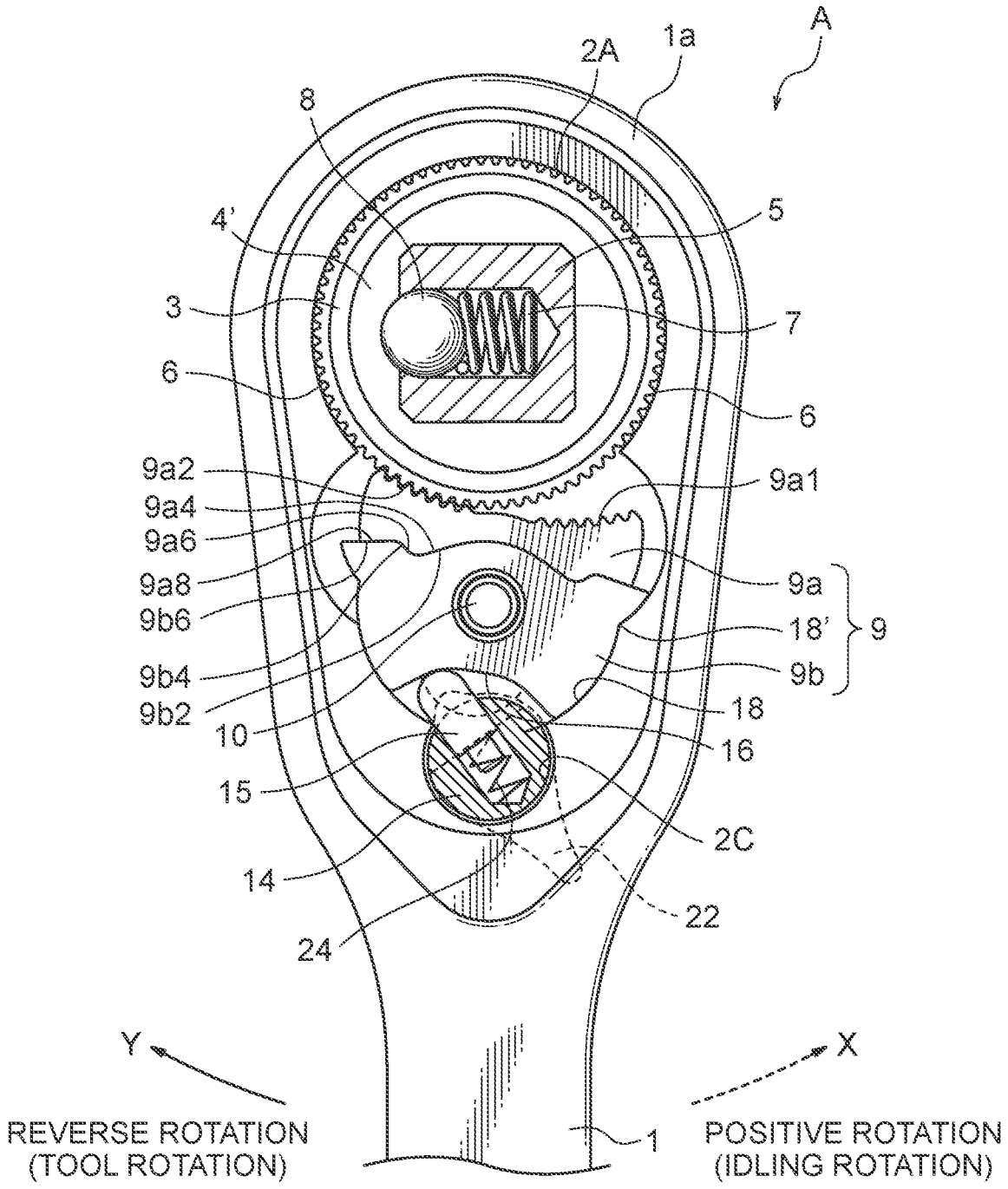
FIG. 9 is a front view of an unveiled main section of the ratchet wrench handle according to one embodiment of the present invention, wherein a switch member is switched to the reverse position to rotate a tool at the time of reverse rotation.

As shown by FIG. 9, when the pressing pin 15 of the switch member 14 is inclined to the left side that is opposite to the right side shown in FIG. 5, thereby switching the state of the ratchet wrench handle A to the locked state at the time of reverse rotation, the ratchet teeth 6 of the rotation member 3 and the reverse rotation-aimed operation teeth 9a2 (see FIG. 4A) engage with each other, as shown in FIG. 9.

In this condition, if the operation handle 1 is rotated in the clockwise direction of Y, even though the operation piece 9 is composed of the two partial members, i.e., the claw member 9a and the receiving member 9b, the claw member's first reverse rotation-aimed sloping face 9a4 (see FIG. 4A) and the receiving member's first reverse rotation-aimed sloping face 9b2 (see FIG. 4B) are contacted under pressure with each other, and at the same time, the claw member's second reverse rotation-aimed sloping face 9a8 (see FIG. 4A) and the receiving member's second reverse rotation-aimed sloping face 9b6 (see FIG. 4B) are contacted under pressure with each other. At this time, because of the wedge effect of the claw member 9a, the claw member 9a and the receiving member 9b that form the operation piece 9 become integral as one body.

As mentioned above, the wedge effect of the claw member 9a makes the claw member 9a and the receiving member 9b that form the operation piece 9, become integral as one body, and thus, the rotation torque of the operation handle 1 is transmitted to the rotation member 3. In this way, the rotation member 3 can be rotated in the reverse direction of Y, thereby rotating the tool in the reverse direction.

Furthermore, in this condition, if the operation handle 1 is rotated in the anti-clockwise direction of X, even though the operation piece 9 is composed of the two partial members, i.e., the claw member 9a and the receiving member 9b, the claw member's positive idling rotation-time pressing face 9a6 (see FIG. 4A) presses the receiving member's positive idling rotation-time pressing face 9b4 (see FIG. 4B), thereby allowing the claw member 9a and the receiving member 9b to rotate as one body in the reverse direction of X, whereby the claw member 9a and the receiving member 9b forming the operation piece 9 swing about the assembling bolt 10, and the ratchet teeth 6 of the rotation member 3 and the reverse rotation-aimed operation teeth 9a2 of the claw member 9a slide over each other, which enables idling (see FIG. 4A).

⟨Summary of the Ratchet Wrench Handle A According to One Embodiment of the Present Invention⟩

As described above, the ratchet wrench handle A according to one embodiment of the present invention comprises an operation piece 9 composed of two partial members, i.e., a claw member 9a provided, on its ratchet teeth 6 side, with positive rotation-aimed operation teeth 9a1 and reverse rotation-aimed operation teeth 9a2 that face and engage with the ratchet teeth 6; and a receiving member 9b rotatably mounted on a handle head 1a via an assembling bolt 10 in such a manner that the receiving member is provided with a cam edge to engage with the switch member and abuts the switch member side of the claw member by applying the side of the receiving member which is located opposite to the cam edge, over the assembling bolt located therebetween, wherein the claw member 9a is provided, on its switch member 14 side which is the side of the claw member 9a opposite the positive rotation-aimed operation teeth 9a1 and the reverse rotation-aimed operation teeth 9a2, with a claw member's first positive rotation-aimed sloping face 9a3 and a claw member's second positive rotation-aimed sloping face 9a7 that are opposite to the positive rotation-aimed operation teeth 9a1, and a claw member's first reverse rotation-aimed sloping face 9a4 and a claw member's second reverse rotation-aimed sloping face 9a8 that are opposite to the reverse rotation-aimed operation teeth 9a2, such that the claw member's first positive rotation-aimed sloping face 9a3, the claw member's second positive rotation-aimed sloping face 9a7, the claw member's first reverse rotation-aimed sloping face 9a4 and the claw member's second reverse rotation-aimed sloping face 9a8 are formed to slope down respectively in such a manner that the distance between the range of the claw member's first positive rotation-aimed sloping face 9a3 and the claw member's second positive rotation-aimed sloping face 9a7 and the range of the positive rotation-aimed operation teeth 9a1 is gradually increased as the sloping faces 9a3 and 9a7 go away from the center of the claw member 9a respectively, and the distance between the range of the claw member's first reverse rotation-aimed sloping face 9a4 and the claw member's second reverse rotation-aimed sloping face 9a8 and the range of the reverse rotation-aimed operation teeth 9a2 is gradually increased as the sloping faces 9a4 and 9a8 go away from the center of the claw member 9a respectively; and the receiving member 9b is provided, on its claw member 9a side, with a receiving member's first positive rotation-aimed sloping face 9b1 and a claw member's second positive rotation-aimed sloping face 9b5 that abut the claw member's first positive rotation-aimed sloping face 9a3 and the claw member's second positive rotation-aimed sloping face 9a7 respectively, and with a receiving member's first reverse rotation-aimed sloping face 9b2 and a receiving member's second reverse rotation-aimed sloping face 9b6 that abut the claw member's first reverse rotation-aimed sloping face 9a4 and the claw member's second reverse rotation-aimed sloping face 9a8 respectively.

In this condition, when the operation handle 1 is rotated in the anti-clockwise direction, with the positive rotation-aimed operation teeth 9a1 of the claw member 9a engaged with the ratchet teeth 6 of the rotation member 3 as shown in FIG. 5, etc., a wedge effect generated by the positive rotation-aimed operation teeth 9a1 of the claw member 9a, the claw member's first positive rotation-aimed sloping face 9a3 and the claw member's second positive rotation-aimed sloping face 9a7 makes the rotation member 3 stop its rotation, thereby rotating the adapter tin the anti-clockwise direction of X. On the other hand, when the operation handle 1 is rotated in the clockwise direction of Y, with the reverse rotation-aimed operation teeth 9a2 of the claw member 9a engaged with the ratchet teeth 6 of the rotation member 3 as shown in FIG. 9, a wedge effect generated by the reverse rotation-aimed operation teeth 9a2 of the claw member 9a, the claw member's first reverse rotation-aimed sloping face 9a4 and the claw member's second reverse rotation-aimed sloping face 9a8 makes the rotation member 3 stop its rotation, thereby rotating the adapter t in the clockwise direction of Y.

Furthermore, although the operation piece 9 is composed of the two partial members, i.e., the claw member 9a and the receiving member 9b, the torque at the time of rotating the tool is received, via the ratchet teeth 6 of the rotation member 3, by the claw member 9a and the receiving member 9b as one body, thereby transmitting the rotation torque to a pressure receiving edge 18 positioned lower than the assembling bolt 10, i.e., to a place close to the switch member 14 disposed on the opposite side of the ratchet wrench handle A from the operation handle 1, in the same way as the ratchet wrench handle A' disclosed by the Prior Art Document 1, Japanese Patent No. 5568273.

Furthermore, because the operation piece 9 is composed of the two partial members, i.e., the claw member 9a and the receiving member 9b, the wedge effect generated by the positive rotation-aimed operation teeth 9a1 of the claw member 9a, the claw member's first positive rotation-aimed sloping face 9a3 and the claw member's second positive rotation-aimed sloping face 9a7 makes the rotation member 3 stop its rotation, thereby rotating the adapter t in the anti-clockwise direction of X; and the wedge effect generated by the reverse rotation-aimed operation teeth 9a2 of the claw member 9a, the claw member's first reverse rotation-aimed sloping face 9a4 and the claw member's second reverse rotation-aimed sloping face 9a8 also makes the rotation member 3 stop its rotation, thereby rotating the adapter t in the clockwise direction of Y. Thus, increase of the number of convexes of the ratchet teeth 6 and the number of convexes of the positive rotation-aimed operation teeth 9a1 and the reverse rotation-aimed operation teeth 9a2 does not cause slippage, and the reduced swing width of the handle provides a high efficiency and high quality ratchet wrench handle, improving workability.

In particular, in the ratchet wrench handle A according to one embodiment of the present invention, each of the angle $\alpha$ formed between the claw member's first positive rotation-aimed sloping face 9a3 and the claw member's reverse idling rotation-time pressing face 9a5, the angle formed between the claw member's first reverse rotation-aimed sloping face 9a4 and the claw member's positive idling rotation-time pressing face 9a6, the angle $\alpha'$ formed between the receiving member's first positive rotation-aimed sloping face 9b1 and the receiving member's reverse idling rotation-time pressing face 9b3 and the angle $\beta'$ formed by the receiving member's first reverse rotation-aimed sloping face 9b2 and the receiving member's positive idling rotation-time pressing face 9b4, is an obtuse angle larger than 90 degrees and smaller than 180 degrees.

For that reason, when the ratchet teeth 6 of the rotation member 3 is engaged with the positive rotation-aimed operation teeth 9a1 or the reverse rotation-aimed operation teeth 9a2 of the claw member 9a, thereby transmitting the rotation torque of the rotation member 3 to the claw member 9a, the side of the claw member 9a not engaged with the ratchet teeth 6 of the rotation member 3 floats up a little, trying to separate from the receiving member 9b, which allows the positive rotation-aimed operation teeth 9a1 or the reverse rotation-aimed operation teeth 9a2 of the claw member 9a to engage with the ratchet teeth 6 of the rotation member 3 without fail. Therefore, increase of the number of convexes of the ratchet teeth 6, the positive rotation-aimed operation teeth 9a1 and the reverse rotation-aimed operation teeth 9a2 does not cause slippage easily, and the reduced swing width of the handle provides a high efficiency and high quality ratchet wrench handle, improving workability.

Furthermore, as particularly shown in FIGS. 4A and 4B, the ratchet wrench handle A according to one embodiment of the present invention has the following construction. The claw member 9a is further provided, on its switch member 14 side and at the same time, on its claw member's first positive rotation-aimed sloping face 9a3 side, with a claw member's reverse idling rotation-time pressing face 9a5 for pressing the receiving member 9b, thereby idling the claw member 9a and the receiving member 9b as one body, when the ratchet wrench handle A idles in the reverse direction. On the other hand, the claw member 9a is further provided, on its switch member 14 side and at the same time, on its claw member's first reverse rotation-aimed sloping face 9a4 side, with a claw member's positive idling rotation-time pressing face 9a6 for pressing the receiving member 9b, thereby idling the claw member 9a and the receiving member 9b as one body, when the ratchet wrench handle A idles in the positive direction. The receiving member 9*b* is further provided, on its claw member 9*a* side and at the same time, on its receiving member's first positive rotation-aimed sloping face 9*b*1 side, with a receiving member's reverse idling rotation-time pressing face 9*b*3 to be pressed by the claw member's reverse idling rotation-time pressing face 9*a*5, thereby idling the claw member 9*a* and the receiving member 9*b* as one body, when the ratchet wrench handle A idles in the reverse direction. On the other hand, the receiving member 9*b* is further provided, on its claw member 9*a* side and at the same time, on its receiving member's first reverse rotation-aimed sloping face 9*b*2 side, with a receiving member's positive idling rotation-time pressing face 9*b*4 to be pressed by the claw member's positive idling rotation-time pressing face 9*a*6, thereby idling the claw member 9*a* and the receiving member 9*b* as one body, when the ratchet wrench handle A idles in the positive direction.

For that reason, although the operation piece 9 of the ratchet wrench handle A according to one embodiment of the present invention is composed of the two partial members, i.e., the claw member 9*a* and the receiving member 9*b*, the claw member 9*a* and the receiving member 9*b* swing about the assembling bolt 10 as one body when the ratchet wrench handle A idles, whereby the ratchet teeth 6 of the rotation member 3 and either the positive rotation-aimed operation teeth 9*a*1 or the reverse rotation-aimed operation teeth 9*a*2 of the claw member 9*a* slide over each other, which provides idling. In this way, the idling function of the ratchet wrench handle A can be surely realized.

Furthermore, in the ratchet wrench handle A according to one embodiment of the present invention, the claw member's reverse rotation-time pressing face 9*a*5 is disposed, as a partition, between the claw member's first positive rotation-aimed sloping face 9*a*3 and the claw member's second positive rotation-aimed sloping face 9*a*7; the claw member's positive rotation-time pressing face 9*a*6 is disposed, as a partition, between the claw member's first reverse rotation-aimed sloping face 9*a*4 and the claw member's second reverse rotation-aimed sloping face 9*a*8; the receiving member's reverse idling-time pressing face 9*b*3 is disposed, as a partition, between the receiving member's first positive rotation-aimed sloping face 9*b*1 and the receiving member's second positive rotation-aimed sloping face 9*b*5; and the receiving member's positive idling-time pressing face 9*b*4 is disposed, as a partition, between the receiving member's first reverse rotation-aimed sloping face 9*b*2 and the receiving member's second reverse rotation-aimed sloping face 9*b*6. The inclination angle of the claw member's second positive rotation-aimed sloping face 9*a*7 located at an outer side of the claw member 9*a* is closer to the horizontal than that of the claw member's first positive rotation-aimed sloping face 9*a*3 located at an inner side of the claw member 9*a*; the inclination angle of the claw member's second reverse rotation-aimed sloping face 9*a*8 located at an outer side of the claw member 9*a* is closer to the horizontal than that of the claw member's first reverse rotation-aimed sloping face 9*a*4 located at an inner side of the claw member 9*a*; the inclination angle of the receiving member's second positive rotation-aimed sloping face 9*b*5 located at an outer side of the receiving member 9*b* is closer to the horizontal than that of the receiving member's first positive rotation-aimed sloping face 9*b*1 located at an inner side of the receiving member 9*b*; and the inclination angle of the receiving member's second reverse rotation-aimed sloping face 9*b*6 located at an outer side of the claw member 9*a* is closer to the horizonal than that of the receiving member's first reverse rotation-aimed sloping face 9*b*2 located at an inner side of the claw member 9*a*.

Therefore, in the ratchet wrench handle A according to one embodiment of the present invention, when the ratchet teeth 9*a* of the rotation member 3 is engaged with the positive rotation-aimed operation teeth 9*a*1 or the reverse rotation-aimed operation teeth 9*a*2 of the claw member 9*a*, thereby transmitting the rotation torque of the rotation member 3 to the claw member 9*a*, the side of the claw member 9*a* not engaged with the ratchet teeth 6 of the rotation member 3 floats up a little and separates from the receiving member 9*b*. In that case, even when the claw member's first positive rotation-aimed sloping face 9*a*3 and the claw member's first reverse rotation-aimed sloping face 9*a*4 that are located at inner sides of the claw member 9*a* try to separate from the receiving member's first positive rotation-aimed sloping face 9*b*1 and the receiving member's first reverse rotation-aimed sloping face 9*b*2 that are located at inner sides of the receiving member 9*b*, the claw member's second positive rotation-aimed sloping face 9*a*7 and the claw member's second reverse rotation-aimed sloping face 9*a*8 that are located at outer sides of the claw member 9*a* surely abut, respectively, the receiving member's second positive rotation-aimed sloping face 9*b*5 and the receiving member's second reverse rotation-aimed sloping face 9*b*6 that are located at outer sides of the claw member 9*b*, because each of the sloping faces 9*a*7, 9*b*5, 9*a*8 and 9*b*6 has an inclination angle closer to the horizontal than the inclination angle of those located at inner sides of the claw member 9*a* and the receiving member 9*b*. This enables transmitting the rotation torque, stress, etc. generated by the rotation member 3 from the claw member 9*a* to the receiving member 9*b*. Therefore, increase of the number of convexes of the ratchet teeth 6, the positive rotation-aimed operation teeth 9*a*1 and the reverse rotation-aimed operation teeth 9*a*2 does not cause slippage easily, and the reduced swing width of the handle provides a high efficiency and high quality ratchet wrench handle, improving workability.

What is claimed is:

1. A ratchet wrench handle comprising:

a rotation member which is disposed at a handle head located at a distal end of an operation handle and includes a portion for attaching an adapter; and an operation piece including positive rotation-aimed operation teeth and reverse rotation-aimed operation teeth, wherein:

the rotation member includes ratchet teeth continuously defined on a periphery of the rotation member and configured to engage, through operation of a switch, with either: (i) the positive rotation-aimed operation teeth to thereby rotate the operation handle in a positive direction; or (ii) the reverse rotation-aimed operation teeth to thereby rotate the operation handle in a reverse direction;

the operation piece is composed of two partial members including a claw member and a receiving member;

the positive rotation-aimed operation teeth and the reverse rotation-aimed operation teeth are defined on the claw member so as to face the ratchet teeth;

the receiving member is rotatably mounted on the handle head via an assembling bolt such that the receiving member: (i) includes a cam edge configured to engage with the switch; and (ii) is configured to abut a switch side of the claw member by applying thereon a side of the receiving member which is located across the assembling bolt from the cam edge;

the claw member includes a claw member positive rotation-aimed sloping face that is on a switch side of the claw member and opposite to the positive rotation-aimed operation teeth and a claw member reverse rotation-aimed sloping face that is on the switch side of the claw member and opposite to the reverse rotation-aimed operation teeth such that the claw member positive rotation-aimed sloping face and the claw member reverse rotation-aimed sloping face slope down whereby a distance between a range of the claw member positive rotation-aimed sloping face and the claw member reverse rotation-aimed sloping face and a range of the positive rotation-aimed operation teeth and the reverse rotation-aimed operation teeth increases as the claw member positive rotation-aimed sloping face or the claw member reverse rotation-aimed sloping face extends away from a center of the claw member;

the receiving member includes a receiving member positive rotation-aimed sloping face configured to abut the claw member positive rotation-aimed sloping face when the operation handle is rotated in the positive direction and a receiving member reverse rotation-aimed sloping face configured to abut the claw member reverse rotation-aimed sloping face when the operation handle is rotated in the reverse direction;

the claw member further includes: (i) on a claw member positive rotation-aimed sloping face side, a claw member reverse idling rotation-time pressing face for pressing the receiving member to thereby idle the claw member and the receiving member as one body when the operation handle idles in the reverse direction; and (ii) on a claw member reverse rotation-aimed sloping face side, with a claw member positive idling rotation-time pressing face for pressing the receiving member to thereby idle the claw member and the receiving member as one body when the operation handle idles in the positive direction; and the receiving member further includes: (i) on a receiving member positive rotation-aimed sloping face side, a receiving member reverse idling rotation-time pressing face configured to be pressed by the claw member reverse idling rotation-time pressing face to thereby idle the claw member and the receiving member as one body when the operation handle idles in the reverse direction; and (ii) on a receiving member reverse rotation-aimed sloping face side, a receiving member positive idling rotation-time pressing face configured to be pressed by the claw member positive idling rotation-time pressing face to thereby idle the claw member and the receiving member as one body when the operation handle idles in the positive direction.

2. The ratchet wrench handle according to claim 1, wherein:

a first angle between the claw member positive rotation-aimed sloping face and the claw member reverse idling rotation-time pressing face is larger than 90 degrees and smaller than 180 degrees;

a second angle between the claw member reverse rotation-aimed sloping face and the claw member positive idling rotation-time pressing face is larger than 90 degrees and smaller than 180 degrees;

a third angle between the receiving member positive rotation-aimed sloping face and the receiving member reverse idling rotation-time pressing face is larger than 90 degrees and smaller than 180 degrees; and a fourth angle between the receiving member reverse rotation-aimed sloping face and the receiving member positive idling rotation-time pressing face is larger than 90 degrees and smaller than 180 degrees.

3. The ratchet wrench handle according to claim 1, wherein:

(i) the claw member positive rotation-aimed sloping face is divided into two parts by the claw member reverse idling rotation-time pressing face;

a first of the two parts of the claw member positive rotation-aimed sloping face is located further outwardly than the claw member reverse idling rotation-time pressing face;

a second of the two parts of the claw member positive rotation-aimed sloping face is located inward from the claw member reverse idling rotation-time pressing face; and the first of the two parts of the claw member positive rotation-aimed sloping face has an inclination angle closer to a horizontal than the second of the two parts of the claw member positive rotation-aimed sloping face;

(ii) the claw member reverse rotation-aimed sloping face is divided into two parts by the claw member positive idling rotation-time pressing face;

a first of the two parts of the claw member reverse rotation-aimed sloping face is located further outwardly than the claw member positive idling rotation-time pressing face;

a second of the two parts of the claw member reverse rotation-aimed sloping face is located inward from the claw member positive idling rotation-time pressing face; and the first of the two parts of the claw member reverse rotation-aimed sloping face has an inclination angle closer to the horizontal than the second of the two parts of the claw member reverse rotation-aimed sloping face;

(iii) the receiving member positive rotation-aimed sloping face is divided into two parts by the receiving member reverse idling rotation-time pressing face;

a first of the two parts of the receiving member positive rotation-aimed sloping face is located further outwardly than the receiving member reverse idling rotation-time pressing face;

a second of the two parts of the receiving member positive rotation-aimed sloping face is located inward from the receiving member reverse idling rotation-time pressing face; and the first of the two parts of the receiving member positive rotation-aimed sloping face has an inclination angle closer to the horizontal than the second of the two parts of the receiving member positive rotation-aimed sloping face; and (iv) the receiving member reverse rotation-aimed sloping face is divided into two parts by the receiving member positive idling rotation-time pressing face;

a first of the two parts of the receiving member reverse rotation-aimed sloping face is located further outwardly than the receiving member positive idling rotation-time pressing face;

a second of the two parts of the receiving member reverse rotation-aimed sloping face is located inward from the receiving member positive idling rotation-time pressing face; and the first of the two parts of the receiving member reverse rotation-aimed sloping face has an inclination angle closer to the horizontal than the second of the two parts of the receiving member reverse rotation-aimed sloping face.

* * * * *